US009155954B2

(12) United States Patent
Newman et al.

(10) Patent No.: US 9,155,954 B2
(45) Date of Patent: Oct. 13, 2015

(54) SPORTS SWING IMPROVEMENT APPARATUS

(71) Applicants: Terry Newman, Belaire, KS (US); Mark Brzon, Wichita, KS (US)

(72) Inventors: Terry Newman, Belaire, KS (US); Mark Brzon, Wichita, KS (US)

( * ) Notice: Subject to any disclaimer, the term of this patent is extended or adjusted under 35 U.S.C. 154(b) by 157 days.

(21) Appl. No.: 13/718,363

(22) Filed: Dec. 18, 2012

(65) Prior Publication Data

US 2014/0171213 A1 Jun. 19, 2014

(51) Int. Cl.

| | |
|---|---|
| ***A63B 69/00*** | (2006.01) |
| ***A63B 69/36*** | (2006.01) |
| *A63B 26/00* | (2006.01) |

(52) U.S. Cl.

CPC ..... *A63B 69/3673* (2013.01); *A63B 69/0002* (2013.01); *A63B 26/003* (2013.01); *A63B 2069/0008* (2013.01); *A63B 2225/09* (2013.01)

(58) Field of Classification Search

CPC ..... A63B 69/0002; A63B 69/3667; A63B 69/3673; A63B 69/367; A63B 2069/0008; A63B 22/14; A63B 21/023; A63B 21/025

USPC ..... 473/452, 217, 218, 270–273

See application file for complete search history.

(56) References Cited

U.S. PATENT DOCUMENTS

| | | | | |
|---|---|---|---|---|
| 3,955,821 | A * | 5/1976 | Spedding | 473/271 |
| 4,146,231 | A * | 3/1979 | Merkle et al. | 473/269 |
| 4,147,356 | A * | 4/1979 | Brandell | 473/271 |
| 5,000,457 | A * | 3/1991 | Brown | 473/273 |
| 5,037,094 | A * | 8/1991 | Johnson | 473/452 |
| 5,263,863 | A * | 11/1993 | Stefani et al. | 473/269 |
| D399,280 | S * | 10/1998 | Griffin | D21/753 |
| 5,976,027 | A * | 11/1999 | Kachmar | 473/273 |
| 7,018,301 | B1 * | 3/2006 | Cascerceri et al. | 473/270 |
| D602,553 | S * | 10/2009 | Wright | D21/780 |
| 8,075,426 | B1 * | 12/2011 | Griffin | 473/452 |
| 8,221,271 | B1 * | 7/2012 | McIntyre | 473/452 |
| 8,517,853 | B2 * | 8/2013 | Miller et al. | 473/270 |
| 8,771,157 | B2 * | 7/2014 | Caponigro | 482/147 |
| 2006/0046864 | A1 * | 3/2006 | Pagano | 473/270 |
| 2007/0082760 | A1 | 4/2007 | Reason-Kerkhoff | |
| 2008/0125294 | A1 | 5/2008 | Takizawa et al. | |
| 2008/0188331 | A1 * | 8/2008 | Shimizu et al. | 473/451 |
| 2010/0062871 | A1 * | 3/2010 | Drollinger et al. | 473/272 |
| 2011/0092318 | A1 * | 4/2011 | Torch | 473/452 |
| 2011/0218059 | A1 * | 9/2011 | Leone et al. | 473/452 |
| 2011/0224028 | A1 * | 9/2011 | Slakey | 473/452 |

FOREIGN PATENT DOCUMENTS

| | | | |
|---|---|---|---|
| RU | 43774 | U1 | 10/2005 |
| SU | 825118 | A1 | 4/1981 |

OTHER PUBLICATIONS

Search Report and Written Opinion for PCT/US2013/074370 mailed Mar. 27, 2014.

* cited by examiner

*Primary Examiner* — Mark Graham
(74) *Attorney, Agent, or Firm* — Hovey Williams LLP

(57) ABSTRACT

An apparatus for improving the swing of a batter or golfer broadly comprises a frame, a forward pedestal, a rear pedestal, and a rear pedestal biasing element. The frame may include at least one horizontal member. The forward pedestal may support a forward foot of the user and may couple to the frame. The rear pedestal may support a rear foot, couple to the frame, be operable to rotate, and be biased to pivot forward. The rear pedestal biasing element may couple to the rear pedestal and urge the rear pedestal to pivot forward.

7 Claims, 7 Drawing Sheets

SPORTS SWING IMPROVEMENT APPARATUS

FIELD OF THE INVENTION

Embodiments of the current invention relate to apparatuses that improve a batter's or a golfer's swing.

DESCRIPTION OF THE RELATED ART

A good baseball swing has many complexities and variables, but certain swing mechanics must be mastered to create a powerful and consistent swing. Perhaps the most important mechanics are loading and extension. Loading occurs before the ball is struck. At loading, the batter's weight should be concentrated on his back leg and his hips should be square to the target. Extension occurs after the ball is struck. During extension, the batter's weight should shift forward, his hips should rotate toward the pitcher, and his rear heel should raise from the ground. When a batter practices his swing, he may simply stand on the ground with his feet spread apart and swing without developing the proper rotation of his body and his feet from loading to extension. Furthermore, he may not get into the habit of raising his back heel to maintain his balance.

A golf swing also has fundamentals that need mastering. Generally, a golfer may have his weight balanced before the swing, but may shift his weight to his rear foot on the backswing and to his front foot on the downswing. Furthermore, his rear foot may rotate forward and his heel may raise while his front foot rotates slightly. The golfer may have similar issues to the batter when practicing by just standing and swinging a golf club. He may not learn to shift his weight properly, rotate his feet properly, and raise his back heel.

SUMMARY OF THE INVENTION

The current invention provides an apparatus for improving the swing of a batter or golfer by encouraging the user to shift his weight and position his body properly during the swing. An embodiment of the apparatus broadly comprises a frame, a forward pedestal, a rear pedestal, and a rear pedestal biasing element. The frame may include at least one horizontal member. The forward pedestal may support a forward foot of a user and may couple to the frame. The rear pedestal may support a rear foot and may couple to the frame. The rear pedestal may also rotate and may be biased to pivot forward. The rear pedestal biasing element may couple to the rear pedestal and urge the rear pedestal to pivot forward.

When practicing a swing, the user may stand on the apparatus with a forward foot on the forward pedestal and a rear foot on the rear pedestal. During loading, the user may have his weight shifted to the rear pedestal, against the biasing of the rear pedestal biasing element. While extending, the user may shift his weight forward as urged by the rear pedestal biasing element and may rotate his hips and his foot as allowed by the rear pedestal.

Other embodiments of the apparatus comprise a frame, a forward pedestal, a rear pedestal, and a rear pedestal biasing element. The frame may include at least one horizontal member. The forward pedestal may support a forward foot of the user and may include a forward base coupled to the horizontal member and a forward platform positioned on top of the forward base. The rear pedestal may support a rear foot and may include a first base member coupled to the at least one horizontal member, a second base member coupled to a forward edge of the first base member with a hinge to allow the second base member to pivot forward with respect to the first base member, and a rear platform positioned on top of the second base member and rotatably coupled thereto. The rear pedestal biasing element may couple to the rear pedestal and urge the rear pedestal to pivot forward.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
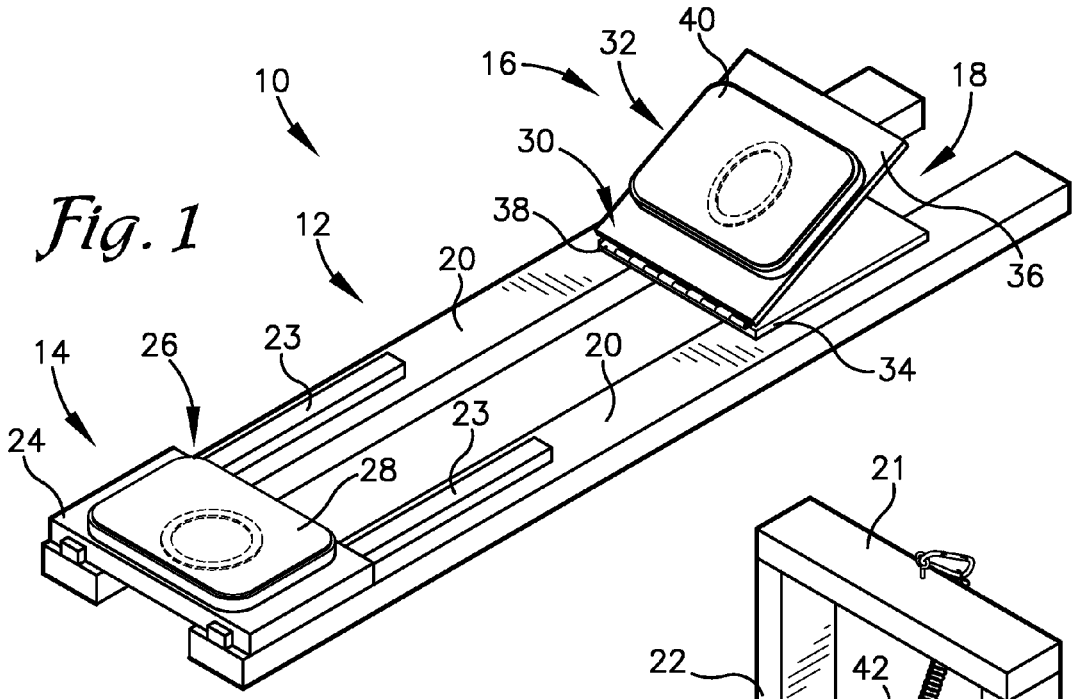
FIG. 1 is a perspective view of an apparatus for improving the swing of a batter or golfer constructed in accordance with certain embodiments of the current invention.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

An apparatus 10 for improving the swing of a batter or golfer, constructed in accordance with various embodiments of the current invention, is shown in FIGS. 1-3 and 7-9. The apparatus 10 may improve a batter's swing by helping him load his weight before swinging, develop a natural rotation of his body and feet, and raise his back heel after striking the ball. The apparatus 10 may improve a golfer's swing by helping him learn to shift his weight properly and raise his back heel as well. Hereinafter, the term "user" may be employed to describe a batter or a golfer. The apparatus 10 may broadly comprise a frame 12, a forward pedestal 14, a rear pedestal 16, and a rear pedestal biasing element 18.

The frame 12 generally retains and supports the forward pedestal 14 and the rear pedestal 16. Accordingly, the frame 12 may include a forward portion or end in proximity to the forward pedestal 14 and a rear portion or end in proximity to the rear pedestal 16. The frame 12 may include one or more horizontal members 20 that contact the ground. In an exemplary embodiment shown in FIGS. 1-3, the frame 12 may include two spaced-apart longitudinal horizontal members 20. The length of the horizontal members 20 may be at least the distance between the outer edges of the user's feet in a normal stance. The width of the frame 12 (the distance between the outer edges of the horizontal members 20) may be at least the length of the user's feet. Alternatively, the frame 12 may include a single elongated horizontal member 20 that is rectangular in shape with the same dimensions as described above.

Figure 2:
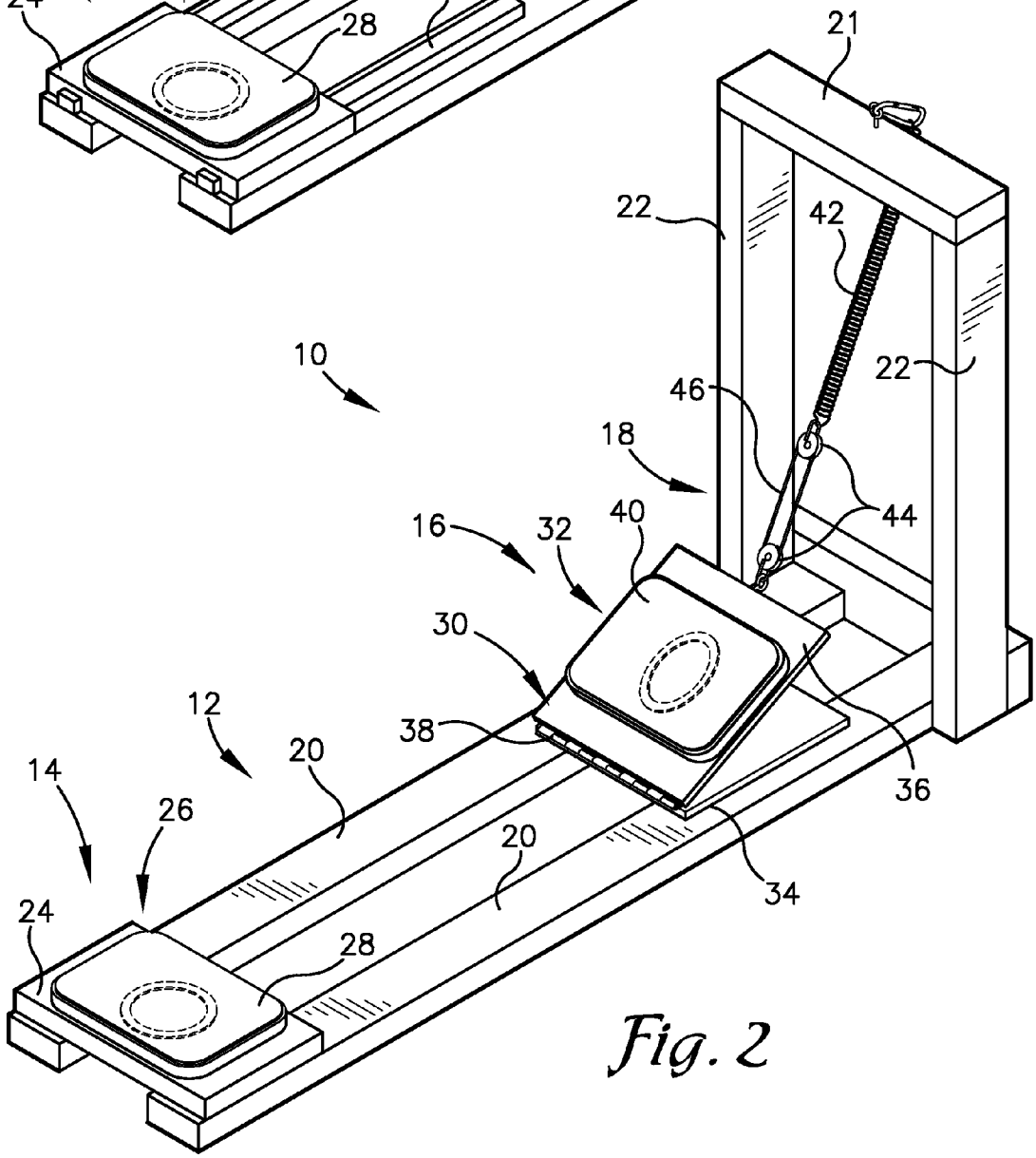
FIG. 2 is a perspective view of an alternative embodiment of the apparatus.
Figure 3:
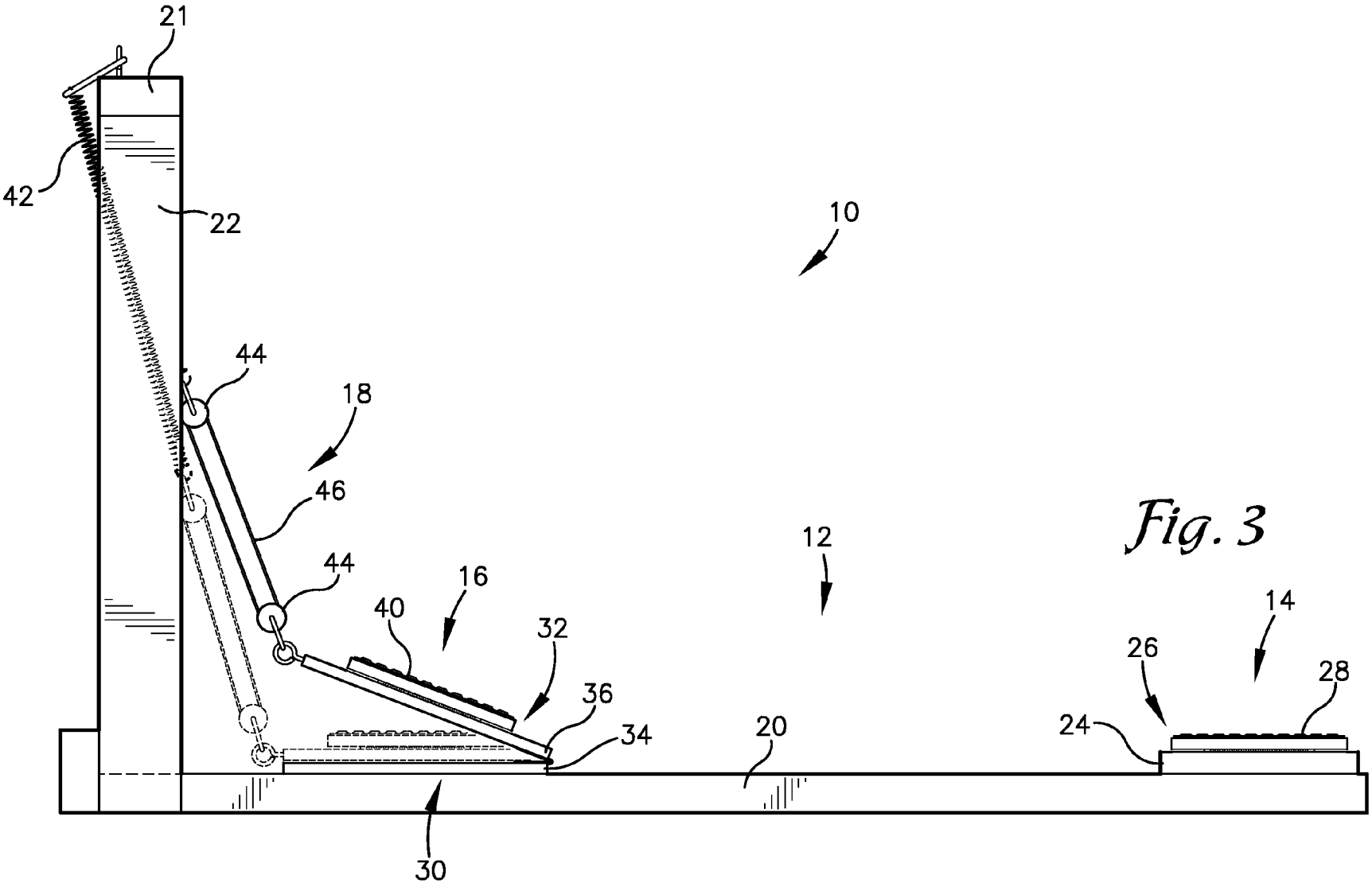
FIG. 3 is a side view of the alternative embodiment of the apparatus.

In some embodiments, as shown in FIGS. 2-3, the frame 12 may include one or more vertical members 22 that retain at least a portion of the rear pedestal biasing element 18, depending on the embodiment of the rear pedestal biasing element 18, as described in more detail below. In an exemplary embodiment, the frame 12 may include two vertical members 22 spaced apart from one another with a crosspiece 21 positioned therebetween. Alternatively, the frame 12 may include a single elongated vertical member 22 that is coupled to the rear end of the frame 12.

The frame 12 may further include components to adjust the separation distance between the forward pedestal 14 and the rear pedestal 16. For example, the frame 12 may include one or more tracks or rails 23 positioned longitudinally on the horizontal members 20, as shown in FIG. 1. The forward pedestal 14 may able to slide along the rails 23 to change its position and then lock in place during operation of the apparatus 10. Alternatively, the horizontal members 20 may include a plurality of holes along their length which allow for easy adjustment of the position of the forward pedestal 14.

The forward pedestal 14 generally supports the forward foot of the user and may include a forward base 24 and a forward platform 26. The forward base 24 is coupled to the horizontal members 20 of the frame 12. The forward platform 26 may be positioned on top of the forward base 24 and coupled to the forward base 24. In some embodiments, the forward platform 26 may be selectively rotatable. In such embodiments, the forward platform 26 may include a bearing mechanism or similar component that couples to the forward base 24 which allows the forward platform 26 to rotate. The forward platform 26 may include an upper surface 28 with a shape that generally matches the shape of a user's foot and may be rectangular, oval, or otherwise elongated. The upper surface 28 may be padded and/or may have a non-slip texture.

The rear pedestal 16 generally supports the rear foot of the user and may include a rear base 30 and a rear platform 32. The rear base 30 may include a first base member 34 that is coupled to the horizontal members 20 of the frame 12, and a second base member 36, generally positioned above the first base member 34, that pivots with respect to the first base member 34. In various embodiments, the rear pedestal 16 may include a hinge 38 that couples the forward edge of the first base member 34 with the forward edge of the second base member 36. Accordingly, the second base member 36 may pivot in the forward direction. The rear platform 32 may be positioned on top of the second base member 36 and coupled to the second base member 36 to be selectively rotatable. The rear platform 32 may include a bearing mechanism or similar component that couples to the second base member 36 which allows the rear platform 32 to rotate. The rear platform 32 may include an upper surface 40 with a shape that matches the shape of a user's foot and may be rectangular, oval, or otherwise elongated. The upper surface 40 may be padded and/or may have a non-slip texture.

The rear pedestal biasing element 18 generally forces the rear platform 32 to pivot forward. The rear pedestal biasing element 18 may include elastic or resilient energy storing devices such as springs. Some embodiments of the rear pedestal biasing element 18, as shown in FIGS. 2-3, may include a coil-type spring 42 with one end coupled to the crosspiece 21 or the vertical members 22 of the frame 12 and the other end coupled to the rear edge of the second base member of the rear base 30. The spring 42 may be positioned above the rear platform 32. When the spring 42 is in tension, it may pull the second base member 36 and, in turn, the rear platform 32 upward which may cause the rear platform 32 to pivot forward. The rear pedestal biasing element 18 may also include other components such as cords or chains in line with the spring 42 to control the length of the spring 42 or to reduce the friction of the coupling elements of the spring 42. For example, the rear pedestal biasing element 18 may include a couple of pulleys 44 and a cable 46 that are in line with the spring 42. One end of the cable 46 may be coupled to one pulley 44 and the other end may be coupled to the other pulley 44, which in turn may connect to the rear edge of the second base member 36. The spring 42 may pull through the cable 46 and the pulleys 44 to bias the rear platform 32 forward.

Figure 4:
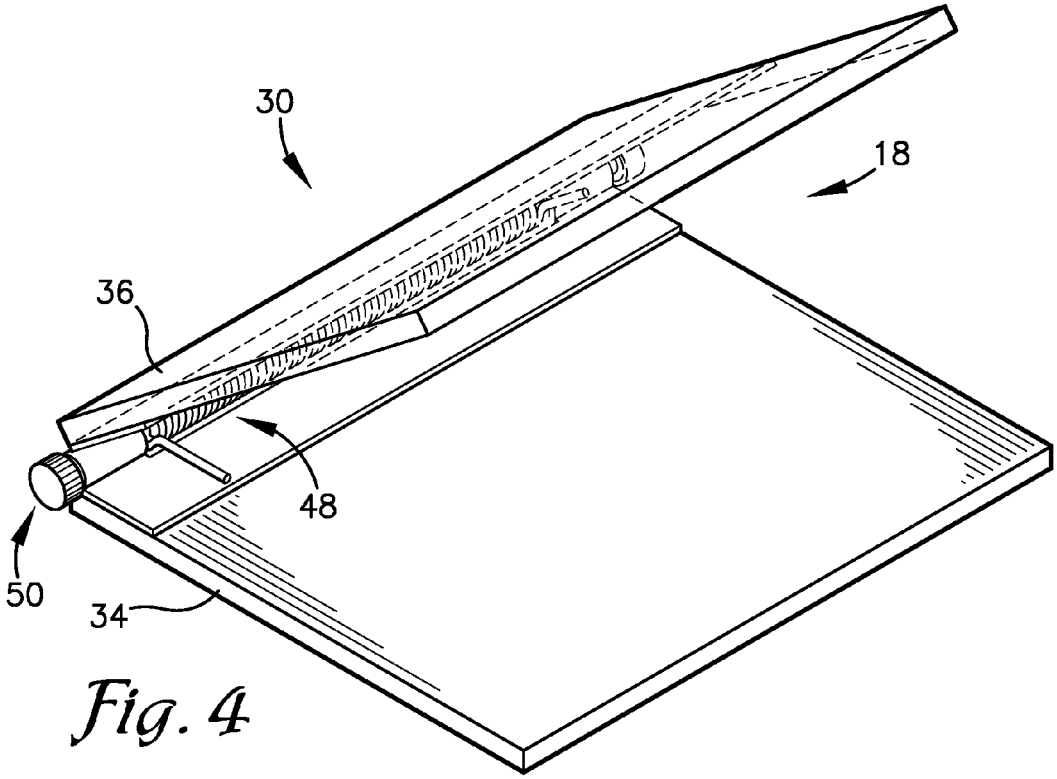
FIG. 4 is a perspective view of a rear pedestal with a first embodiment of a rear pedestal biasing element.

Other embodiments of the rear pedestal biasing element 18 may include a hinge spring or a spring-loaded hinge 48, as shown in FIG. 4, that either couples to the hinge 38 or replaces the hinge 38. The spring hinge 48 may generally urge the second base member 36 to pivot forward with respect to the first base member 34. The rear pedestal biasing element 18 may additionally include a torque adjustment device 50 that allows the user to adjust the amount of torque on the second base member 36 of the rear pedestal 16 to bias it forward. The amount of torque may depend on the weight of the user. For example, a heavier user may desire or require more torque, while a lighter weight user may desire or require less torque.

Figure 5:
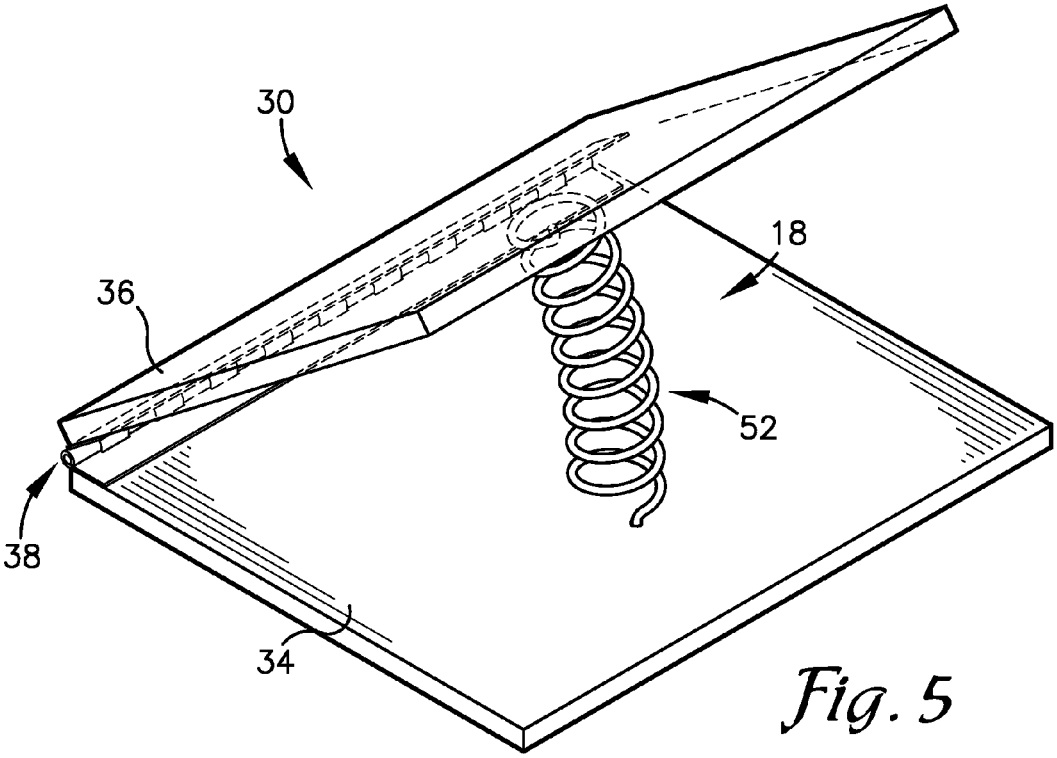
FIG. 5 is a perspective view of the rear pedestal with a second embodiment of the rear pedestal biasing element.

Still other embodiments of the rear pedestal biasing element 18 may include a compression spring 52 with a first end coupled to the first base member 34 and a second end coupled to the second base member 36 of the rear base 30, as shown in FIG. 5. When the spring 52 is in compression, it may push the second base member 36 and, in turn, the rear platform 32 upward, thereby causing the rear platform 32 to pivot forward.

Figure 6:
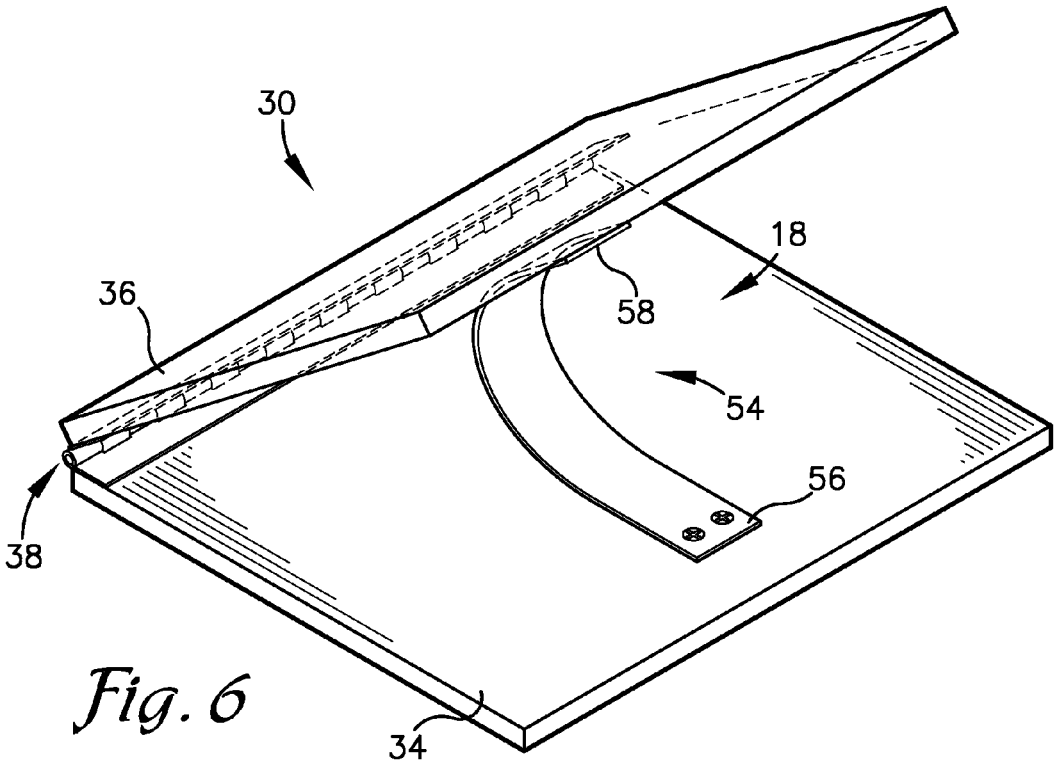
FIG. 6 is a perspective view of the rear pedestal with a third embodiment of the rear pedestal biasing element.

Certain embodiments of the rear pedestal biasing element 18 may include a leaf spring 54, as shown in FIG. 6. The leaf spring 54 may have a "U" shape while at rest with a first side 56 coupled to the first base member 34 of the rear base 30 and an opposing second side 58 coupled to the second base member 36. When the side 56, 58 are pushed together (by the user standing on the rear platform 32) the leaf spring 54 is in compression and biases the rear platform 32 to pivot forward.

Figure 7:
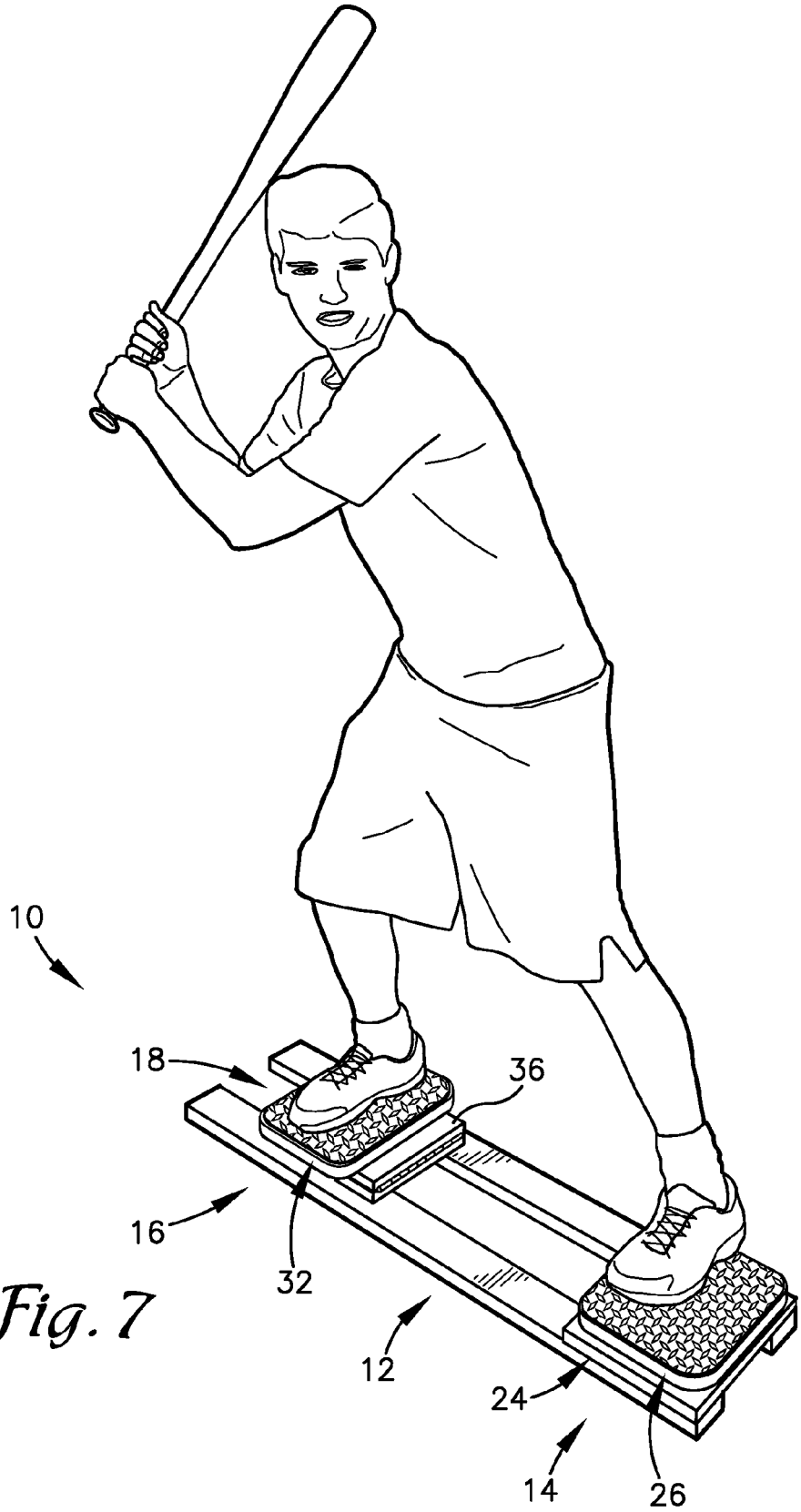
FIG. 7 is a perspective view of the apparatus in operation with a user in a pre-swing or loading stance.
Figure 8:
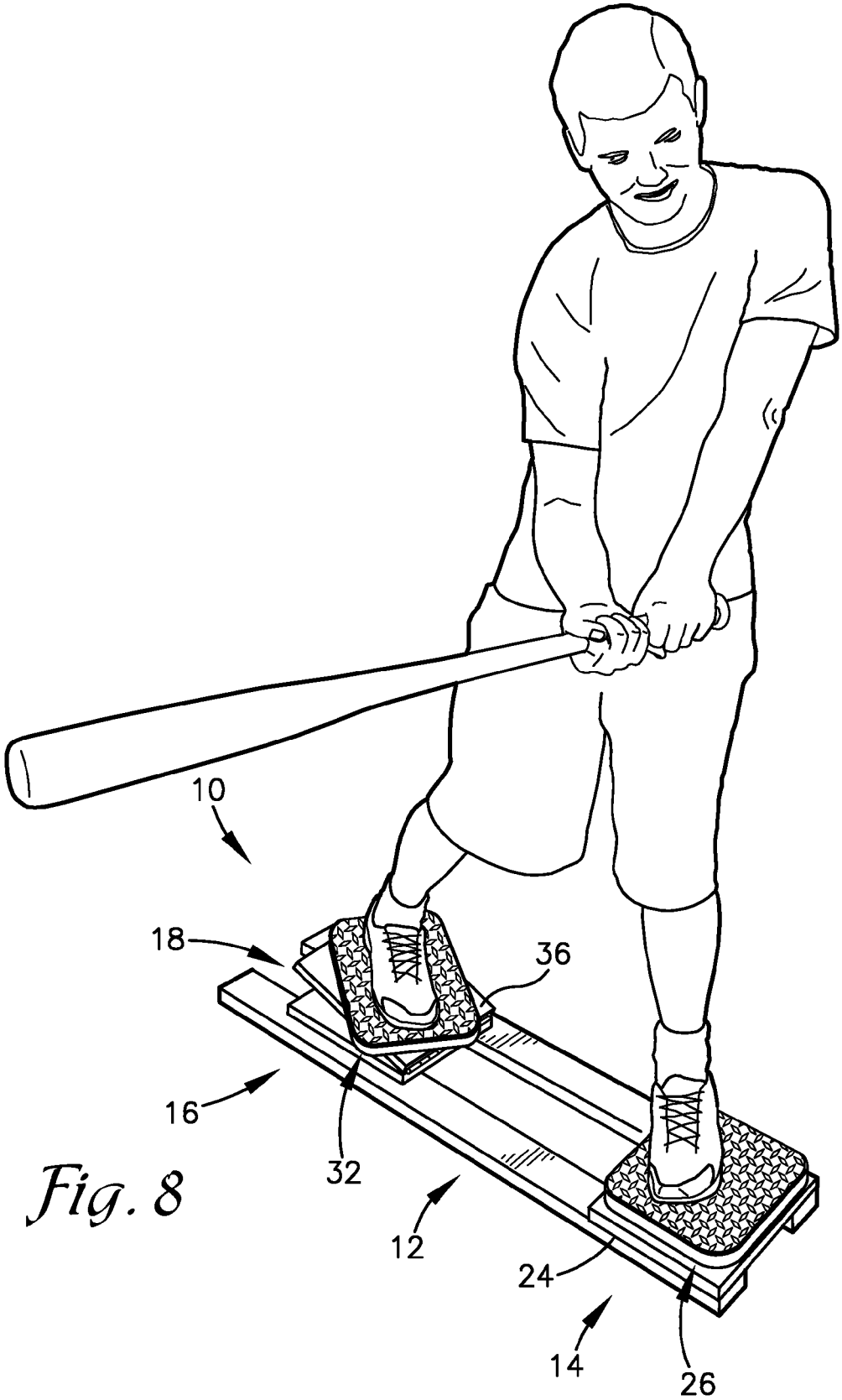
FIG. 8 is a perspective view of the apparatus in operation with the user in a mid-swing stance.
Figure 9:
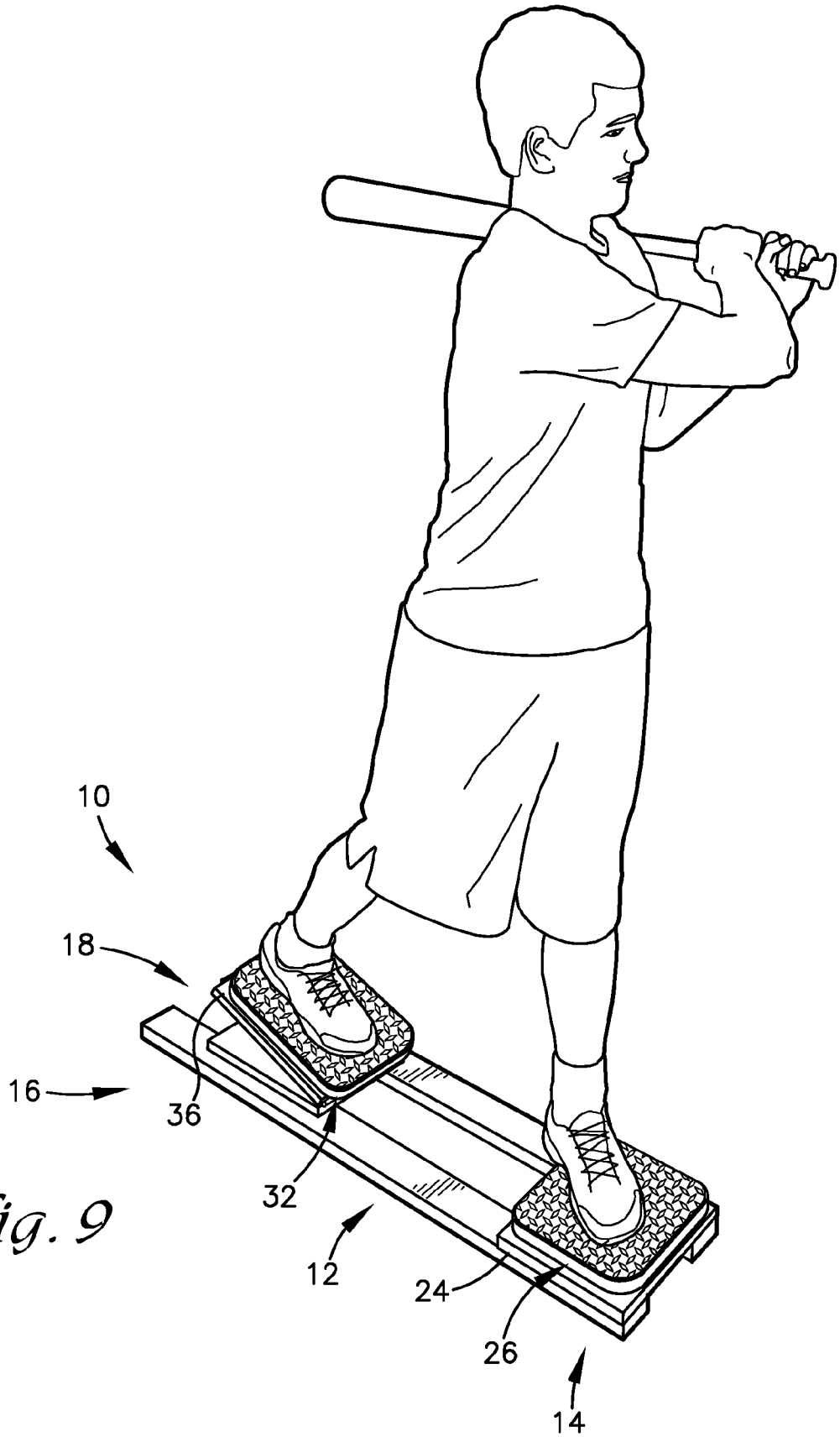
FIG. 9 is a perspective view of the apparatus in operation with the user in a post-swing or extension stance.

Referring to FIGS. 7-9, the apparatus 10 may operate as follows. Although the apparatus 10 is shown in operation with a batter practicing his swing, the operation may be similar with a golfer practicing his swing. The apparatus 10 may be placed such that the horizontal members 20 contact the ground. If necessary, the user may adjust the position of the forward pedestal 14 such that the distance between the pedestals 14, 16 matches his stance. In addition, if the upper surfaces 28, 40 of the pedestals 14, 16 are shaped with an elongation similar to a user's foot, then the forward platform 26 and the rear platform 32 may be rotated such that the elongation is transversely oriented to the longitudinal axis of the horizontal members 20 of the frame 12. The user may take either a right-handed or left-handed approach and may stand on the apparatus 10 with his forward foot on the forward pedestal 14 and his rear foot on the rear pedestal 16.

When in a pre-swing or loading stance, the user may have his weight shifted rearward, thereby pressing the rear platform 32 downward, as seen in FIG. 7, in opposition to the natural biasing of the rear pedestal biasing element 18. The rear platform 32 may be generally horizontal or flat. As the user swings, the rear foot and, in turn, the rear pedestal 16 may rotate, such that the toes of the rear foot progressively point forward, as seen in FIG. 8. In addition, the user may progressively shift his weight forward which allows the rear platform 32 to pivot forward, as urged by the rear pedestal biasing element 18, and raise the user's heel of his rear foot. At the end of the swing, the user's forward foot may rotate slightly on the forward pedestal 14, while the user's rear foot and the rear platform 32 may have rotated through a range including 90 degrees, as seen in FIG. 9. Furthermore, the rear platform 32 may have pivoted forward, thereby raising the user's heel of his rear foot several inches. If the user fails to shift his weight forward or rotate his feet properly during the swing, then the force of the rear pedestal biasing element 18 may cause the user to lose his balance and step off of the apparatus 10. Thus, the apparatus 10 encourages the user to develop proper body rotation and weight transfer. The apparatus 10 may be utilized in isolation, wherein the user simply practices his swing, or on a field or a course, wherein the user practices while actually hitting a baseball or a golf ball.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. An apparatus for improving the swing of a batter or golfer, the apparatus comprising:

a frame including at least one horizontal member;

a forward pedestal for supporting a forward foot of a user, the forward pedestal coupled to the frame;

a rear pedestal for supporting a rear foot, the rear pedestal coupled to the frame, the rear pedestal including a rear base biased to pivot forward and a rear platform positioned on top of the rear base and rotatably coupled thereto, wherein the rear base includes a first base member coupled to the at least one horizontal member and a second base member coupled to a forward edge of the first base member with a hinge to allow the second base member to pivot forward with respect to the first base member; and a rear pedestal biasing element coupled to the rear pedestal to urge the rear pedestal to pivot forward, the rear pedestal biasing element including a hinge spring that couples to the hinge and a torque adjustment device operable to vary the torque applied to the second base member.

2. The apparatus of claim 1, wherein the forward pedestal includes a forward base coupled to the at least one horizontal member and a forward platform positioned on top of the forward base.

3. The apparatus of claim 1, further comprising at least one rail coupled to the at least one horizontal member and the forward pedestal for adjusting the distance between the forward pedestal and the rear pedestal.

4. The apparatus of claim 1, wherein the rear pedestal includes a bearing mechanism which allows the rear pedestal to rotate.

5. An apparatus for improving the swing of a batter or golfer, the apparatus comprising:

a frame including at least one horizontal member;

a forward pedestal for supporting a forward foot of a user, the forward pedestal including a forward base coupled to the at least one horizontal member and a forward platform positioned on top of the forward base;

a rear pedestal for supporting a rear foot, the rear pedestal including a first base member coupled to the at least one horizontal member, a second base member coupled to a forward edge of the first base member with a hinge to allow the second base member to pivot forward with respect to the first base member, and a rear platform positioned on top of the second base member and rotatably coupled thereto; and a rear pedestal biasing element coupled to the rear pedestal to urge the rear pedestal to pivot forward, the rear pedestal biasing element including a hinge spring that couples to the hinge and a torque adjustment device operable to vary the torque applied to the second base member.

6. The apparatus of claim 5, further comprising at least one rail coupled to the at least one horizontal member and the forward pedestal for adjusting the distance between the forward pedestal and the rear pedestal.

7. The apparatus of claim 5, wherein the rear platform includes a bearing mechanism coupled to the second base member which allows the rear platform to rotate.

* * * * *